US009290915B2

(12) United States Patent
Marchand

(10) Patent No.: US 9,290,915 B2
(45) Date of Patent: Mar. 22, 2016

(54) MECHANICAL SYSTEM COMPRISING A WEAR PART AND A SUPPORT, AND A BUCKET COMPRISING AT LEAST ONE SUCH MECHANICAL SYSTEM

(71) Applicant: Fabrice Marchand, Saint Galmier (FR)

(72) Inventor: Fabrice Marchand, Saint Galmier (FR)

(73) Assignee: SAFE METAL, Lyons (FR)

( * ) Notice: Subject to any disclaimer, the term of this patent is extended or adjusted under 35 U.S.C. 154(b) by 0 days.

(21) Appl. No.: 14/362,722

(22) PCT Filed: Dec. 7, 2012

(86) PCT No.: PCT/EP2012/074860
§ 371 (c)(1),
(2) Date: Jun. 4, 2014

(87) PCT Pub. No.: WO2013/083812
PCT Pub. Date: Jun. 13, 2013

(65) Prior Publication Data

US 2014/0360062 A1 Dec. 11, 2014

(30) Foreign Application Priority Data

Dec. 8, 2011 (FR) ..... 11 61353

(51) Int. Cl.
*E02F 9/28* (2006.01)

(52) U.S. Cl.
CPC ..... *E02F 9/2858* (2013.01); *E02F 9/2825* (2013.01)

(58) Field of Classification Search
CPC ..... E02F 9/2825; E02F 9/2808; E02F 9/2816; E02F 9/2858
USPC ..... 37/452, 453, 455
See application file for complete search history.

(56) References Cited

U.S. PATENT DOCUMENTS 5,068,986 A 12/1991 Jones
5,983,534 A * 11/1999 Robinson et al. ..... 37/459
7,703,224 B2 * 4/2010 Karlsson et al. ..... 37/457

(Continued)

FOREIGN PATENT DOCUMENTS

AU 2005311135 6/2006
CN 2122174 11/1992

(Continued)

OTHER PUBLICATIONS

International Search Report, dated Apr. 18, 2013, from corresponding PCT application.

(Continued)

*Primary Examiner* — Matthew D Troutman
(74) *Attorney, Agent, or Firm* — Young & Thompson

(57) ABSTRACT

A mechanical system includes a wear part and a support, belonging to the equipment of a construction machine. The support includes a base, a nose which extends from the base along a main axis, and to each side of the base, a housing for receiving a lug of the wear part. The nose includes a first area located near the proximal end of the nose and which includes at least six planar faces arranged in opposite pairs delimiting sections of a first type, and a second area located near the distal end of the nose and which includes at least six planar faces arranged in opposite pairs delimiting sections of a second type, each planar face of the second area being less inclined, relative to the main axis, than the planar face of the first area, which is located in the extension of the planar face in the proximal direction.

19 Claims, 6 Drawing Sheets

(56) References Cited

U.S. PATENT DOCUMENTS

| | | | | |
|---|---|---|---|---|
| 8,261,472 | B2 * | 9/2012 | Ruvang | 37/456 |
| 9,009,996 | B2 * | 4/2015 | Amada et al. | 37/460 |
| 2004/0148821 | A1 * | 8/2004 | Keech et al. | 37/452 |
| 2004/0244235 | A1 * | 12/2004 | Molino et al. | 37/450 |
| 2006/0143953 | A1 * | 7/2006 | Karlsson et al. | 37/456 |
| 2007/0051022 | A1 * | 3/2007 | Meyers et al. | 37/455 |
| 2007/0227051 | A1 | 10/2007 | Carpenter | |
| 2008/0201996 | A1 | 8/2008 | Pasqualini | |
| 2010/0236108 | A1 | 9/2010 | Ruvang | |
| 2011/0099862 | A1 * | 5/2011 | Snyder | 37/455 |
| 2013/0180137 | A1 * | 7/2013 | Hurley et al. | 37/455 |
| 2013/0185965 | A1 * | 7/2013 | Bartolome Rodriguez | 37/453 |
| 2013/0247428 | A1 * | 9/2013 | Hughes | 37/455 |
| 2014/0082976 | A1 * | 3/2014 | Vicq et al. | 37/453 |
| 2014/0245645 | A1 * | 9/2014 | Marchand | 37/444 |
| 2014/0298692 | A1 * | 10/2014 | Marchand | 37/444 |
| 2015/0033601 | A1 * | 2/2015 | Kunz | 37/455 |

FOREIGN PATENT DOCUMENTS

| | | | |
|---|---|---|---|
| WO | 2004/057117 | A1 | 7/2004 |
| WO | 2006059043 | A1 | 6/2006 |
| WO | 2008/119103 | A1 | 10/2008 |
| WO | WO2012/075531 | * | 6/2012 |

OTHER PUBLICATIONS

FR Search Report, dated Jun. 11, 2012, from corresponding FR application.

* cited by examiner

MECHANICAL SYSTEM COMPRISING A WEAR PART AND A SUPPORT, AND A BUCKET COMPRISING AT LEAST ONE SUCH MECHANICAL SYSTEM

The present invention concerns a mechanical system comprising a wear part and a support belonging to a piece of heavy-construction machine equipment. The invention also relates to a heavy-construction machine bucket comprising such a mechanical system.

The field of application of the invention is that of civil engineering machinery equipment, in particular buckets, hoppers or other receptacles that may scrape, remove and transport materials so that they may be evacuated from a given location to other workstations using heavy-construction machines.

In a known manner, a bucket comprises a leading blade equipped with wear parts designed for their ability to penetrate material and to protect other elements constituting the bucket. On the leading blades, adapter supports are fixed having a profiled nose, while the wear parts are teeth or shields that are positioned so as to fit on the adapter support in accordance with a precise connection. The connection is temporary so as to allow the replacement of the wear parts after wear. The mechanical system including a tooth and its support is generally assembled firstly by complementality of shapes between the support nose and an internal recess of the tooth and, secondly, by means of a removable connection device of the keying type. In order to satisfy the current safety requirements, the connection device is adapted to dispense with striking operations for both mounting and demounting of the tooth.

In practice, the manufacturing tolerances require clearances to enable the tooth to be assembled on its support, to which there are added the clearances formed by the pressure hammering and the wear in service of the contact zones, which leaves a possibility of movement of the tooth on its support. Consequently the horizontal, lateral, oblique or miscellaneous stresses inherent in the applications and uses of a civil engineering machine cause deteriorations in the tooth/nose relationship, but also on the keying device. Furthermore, the profile of the nose determines the internal profile of the teeth and therefore the presence and magnitude of the localised weakening zones on this tooth.

WO-A-2006 059 043 and WO-A-2004 057 117 describe mechanical systems each comprising a tooth, a support and a keying device. Each support comprises a nose for fitting the tooth.

In WO-A-2006 059 043, corresponding to the preamble of claim 1, the support also comprises housings for receiving lugs belonging to the tooth. Each housing comprises an open side and three closed sides, while the corresponding lug comprises three substantially flat faces. In practice, the top and bottom faces of the lug come to be locked against the top and bottom edges of the housing. This configuration effectively prevents tilting of the tooth with respect to the support under the action of a digging force, which represents the main mechanical stress liable to be suffered by the tooth in service. The profile of the nose is satisfactory, but may be improved.

In WO-A-2004 057 117, the nose comprises flat surfaces connected by rounded fillets, in accordance with a configuration that is not entirely satisfactory in terms of resistance to the forces in service. In particular, the end of the nose has a parallelepipidal profile, which creates large weakening zones inside the tooth. Moreover, rounded lugs are provided on the support and are received in rounded orifices in the tooth, which is not satisfactory when a digging force is applied on the tooth.

The aim of the present invention is to propose an improved mechanical system having an increased service life compared with the existing devices.

To this end, the subject matter of the invention is a mechanical system comprising a wear part and a support that belong to a heavy-construction machine bucket, the support comprising:

- a base,
- a nose that extends from the base along a principal axis, between a proximal end close to the base and a distal end opposite to the base, the nose having a set of cross-sections, in planes perpendicular to the principal axis, that change in a proximal direction while delimiting increasing or constant areas, in particular not delimiting any decreasing area, apart from the presence of a housing for receiving a connection device in the nose, and
- on each side of the base, a housing receiving a lug belonging to the wear part, the housing being provided in the base in line with the nose, with an open side in a distal direction as well as three closed sides.

The mechanical system is characterised in that the nose comprises:

- a first zone that is situated in the vicinity of the proximal end of the nose and comprises at least six flat faces opposite in pairs delimiting cross-sections of a first type, and
- a second zone that is situated in the vicinity of the distal end of the nose and comprises at least six flat faces opposite in pairs delimiting cross-sections of a second type, each flat face of the second zone being less inclined, with respect to the principal axis, than the flat face of the first zone that is situated in line with it along the proximal direction.

Thus, the nose has a changing shape, with a gradual transition between the flat faces because of their large number and their relative inclinations. The invention makes it possible to reduce the zones of concentrations of mechanical stresses within the mechanical system and therefore improves the service life of this system, both of the tooth and of its support. In each zone, some flat faces are designed to absorb the forces in service, while other flat faces are provided for reducing the concentrations of stresses and the weight of the nose. For an equivalent weight of the support, the nose comprises less material, which makes it possible to have more material on the attachment of the support to the bucket and further improves its service life. Equally, a less bulky nose makes it possible to produce a tooth that is less bulky in height, which facilitates the penetration of the tooth/support/bucket assembly in the material. Finally, the ratio of the weight of the worn tooth to the weight of the new tooth is improved compared with existing systems.

According to other advantageous features of the invention, taken in isolation or in combination:

- The first zone of the nose comprises at least eight flat faces opposite in pairs, at least some of the opposite flat faces preferably being parallel to each other.
- The second zone of the nose comprises at least six flat faces parallel in pairs, preferably at least eight flat faces parallel in pairs.
- The nose comprises a third intermediate zone between the first zone and the second zone of the nose along the principal axis, the third zone comprising at least six faces opposite in pairs delimiting cross-sections of a third type in planes perpendicular to the principal axis, preferably at least four flat faces and four left-hand faces opposite in pairs, the areas delimited by the cross-sections of the third type having, in the proximal direction, a rate of increase greater than the rate of increase of the areas delimited by the cross-sections of the first type and the rate of increase of the areas delimited by the cross-sections of the second type.

The flat faces of the first zone, the second zone and the third zone which are situated firstly in the same plane comprising the principal axis and, secondly, on the same side of the principal axis, are inclined with respect to each other at obtuse angles of between 160 and 200 degrees.

The flat faces of the third zone comprise firstly primary faces having the same inclination with respect to the principal axis as the flat faces of the first zone that are in line with them in the proximal direction, these primary faces being able to withstand mechanical forces exerted on the nose when a digging force is applied to the wear part, and secondly secondary faces overall more inclined with respect to the principal axis than the flat faces of the first zone that are in line with them in the proximal direction.

The third zone of the nose comprises two flat faces perpendicular to a vertical plane, preferably two flat faces perpendicular to a horizontal plane, and at least four faces oriented otherwise than at a right angle both with respect to the vertical plane and with respect to the horizontal plane.

When a force is applied to the wear part, the support and the wear part comprises at least one contact interface from: a first contact interface situated between each lug and the housing receiving this lug, a second contact interface situated between the wear part and the flat faces of the second zone that extend substantially perpendicular to the force, a third contact interface situated between the wear part and the flat faces of the first zone that extend in line with the second contact interface in the proximal direction, where applicable a fourth contact interface situated between the wear part and the flat faces of the third zone that extend in line with the second contact interface in the proximal direction, and a fifth contact interface situated between the wear part and a flat face that is perpendicular to the principal axis and arranged at the distal end of the nose, the number of simultaneous contact interfaces in service depending firstly on the direction of the force and secondly on the wear on the wear part and/or support.

The nose has at least one symmetry plane including the principal axis, in particular a vertical plane and/or a horizontal plane, the principal axis preferably being a symmetry axis of the nose.

Another subject matter of the invention is a heavy-construction machine bucket, comprising at least one mechanical system as mentioned above. In practice, the bucket generally comprises a series of supports each receiving a tooth, which behaves as a wear part and is secured to its support by a connecting device.

As an alternative, other civil engineering machinery equipment can also be equipped with the mechanical system according to the invention.

The invention will be better understood from a reading of the following description, given solely by way of non-limitative example and made with reference to the accompanying drawings, in which:

FIGS. 1 to 9 show a mechanical system 1 according to the invention, equipping a bucket G of a civil engineering machine.

Figure 1:
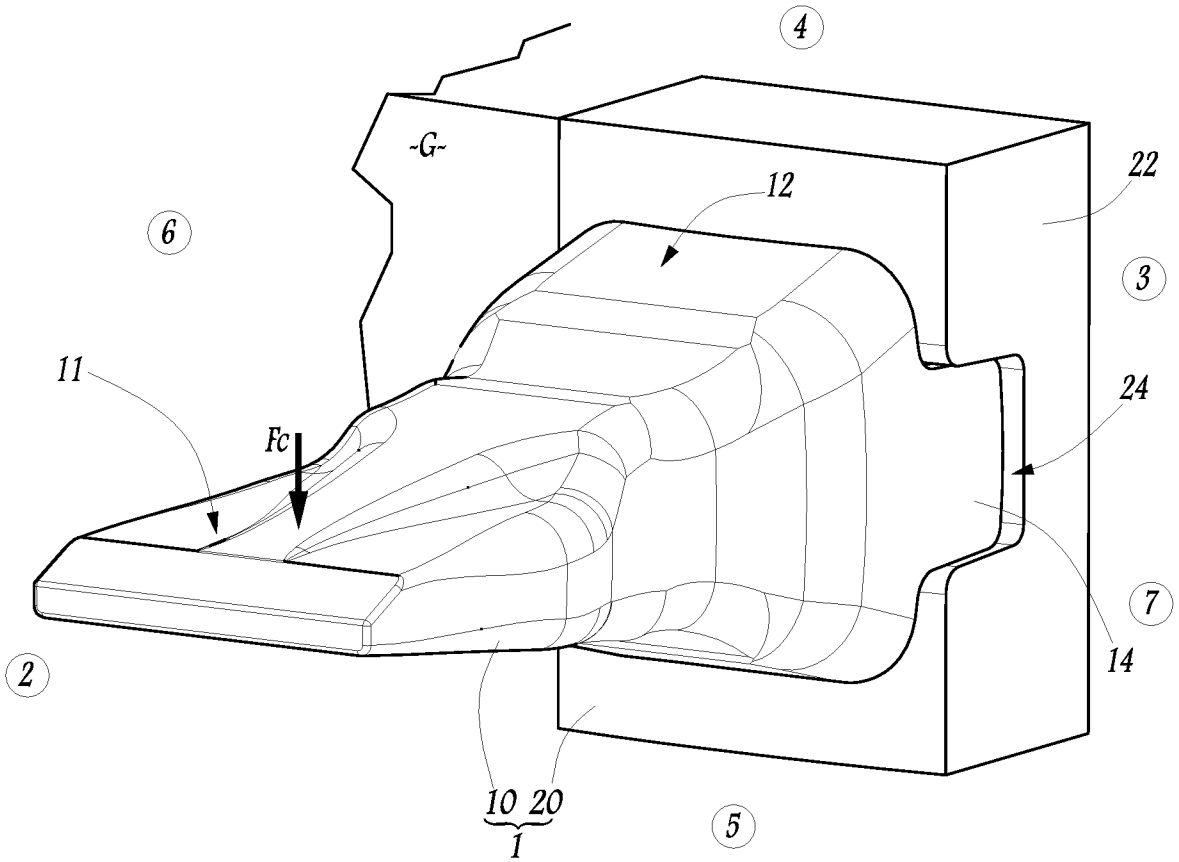
FIG. 1 is an assembled perspective view of a mechanical system according to the invention, comprising a wear part mounted on a support secured to a bucket, partially depicted, while the connecting device between the wear part and the support is not shown.
Figure 2:
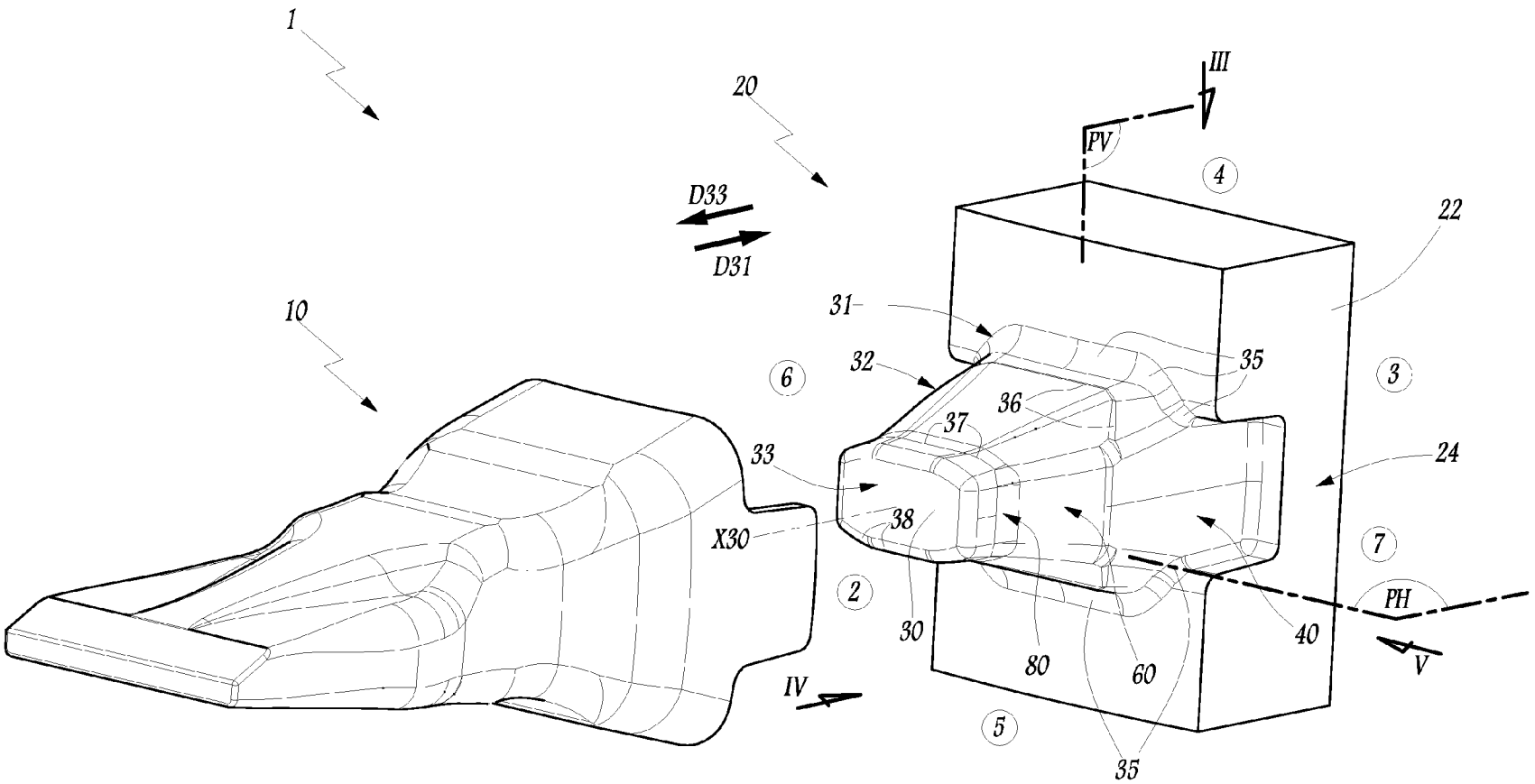
FIG. 2 is a disassembled perspective view of the mechanical system of FIG. 1, comprising the support and the wear part.
Figure 3:
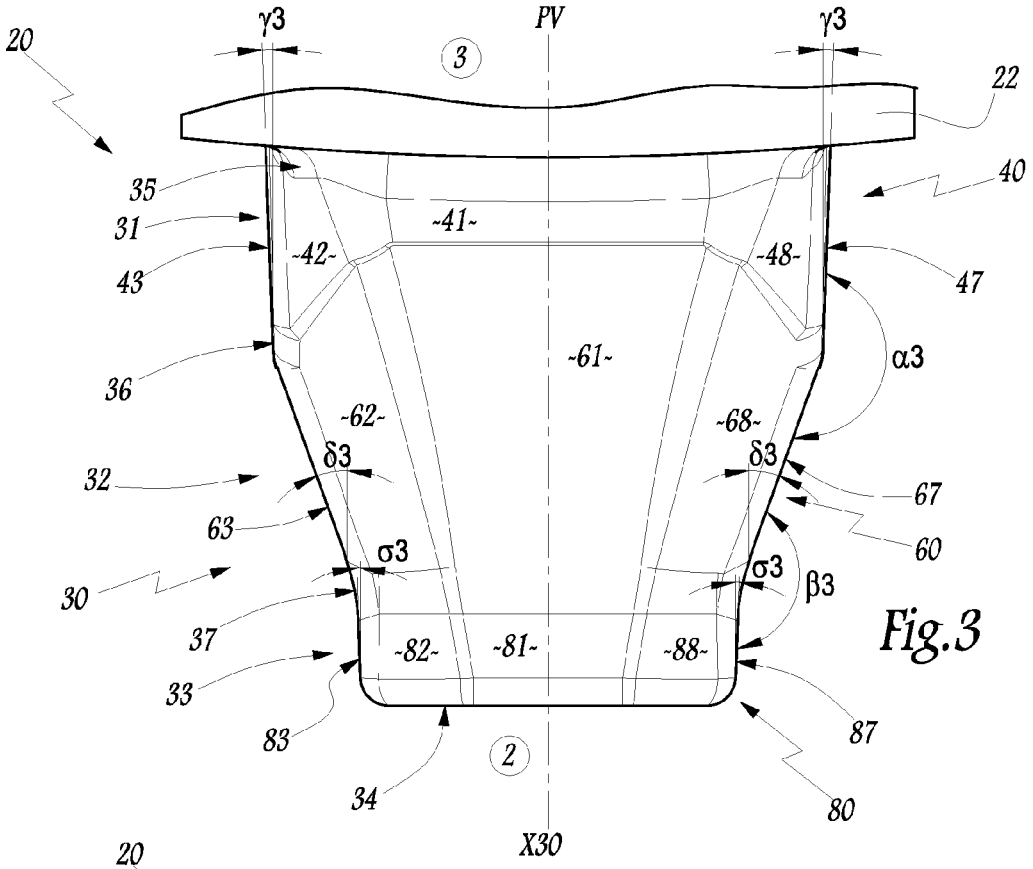
FIGS. 3 to 5 are elevation views of the support, respectively in the direction of the arrows III, IV and V in FIG. 2.
Figure 4:
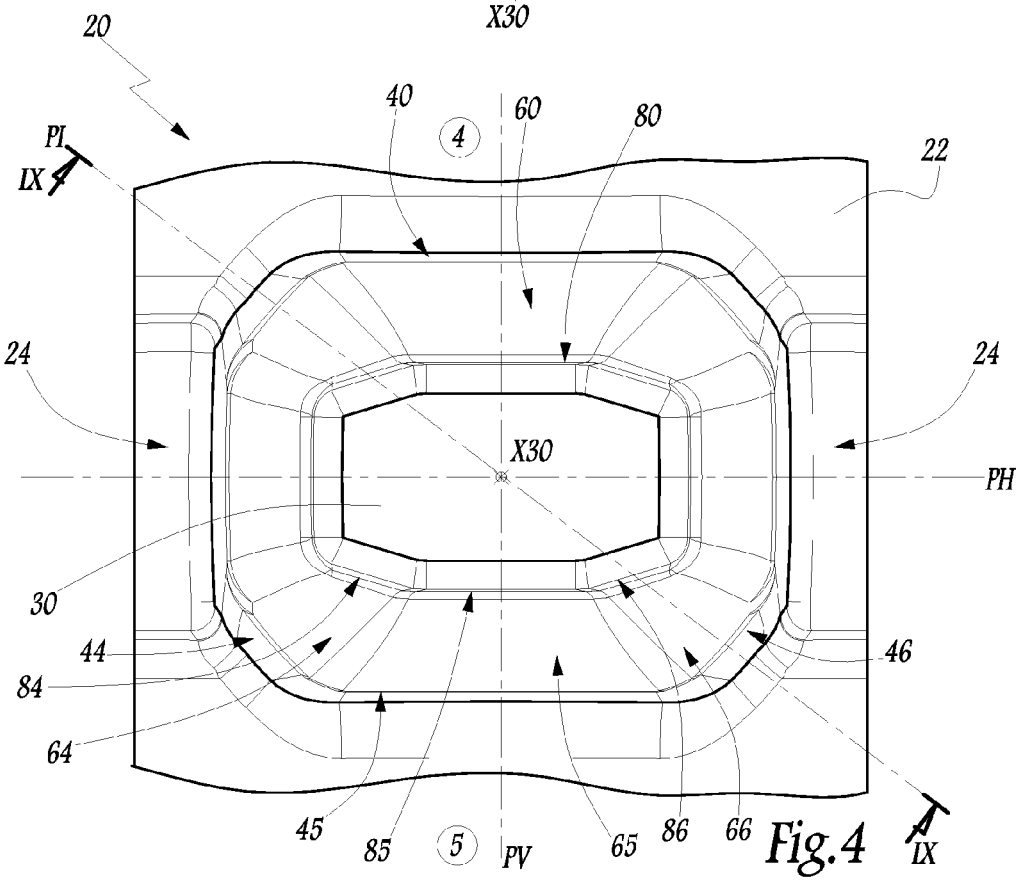
Figure 5:
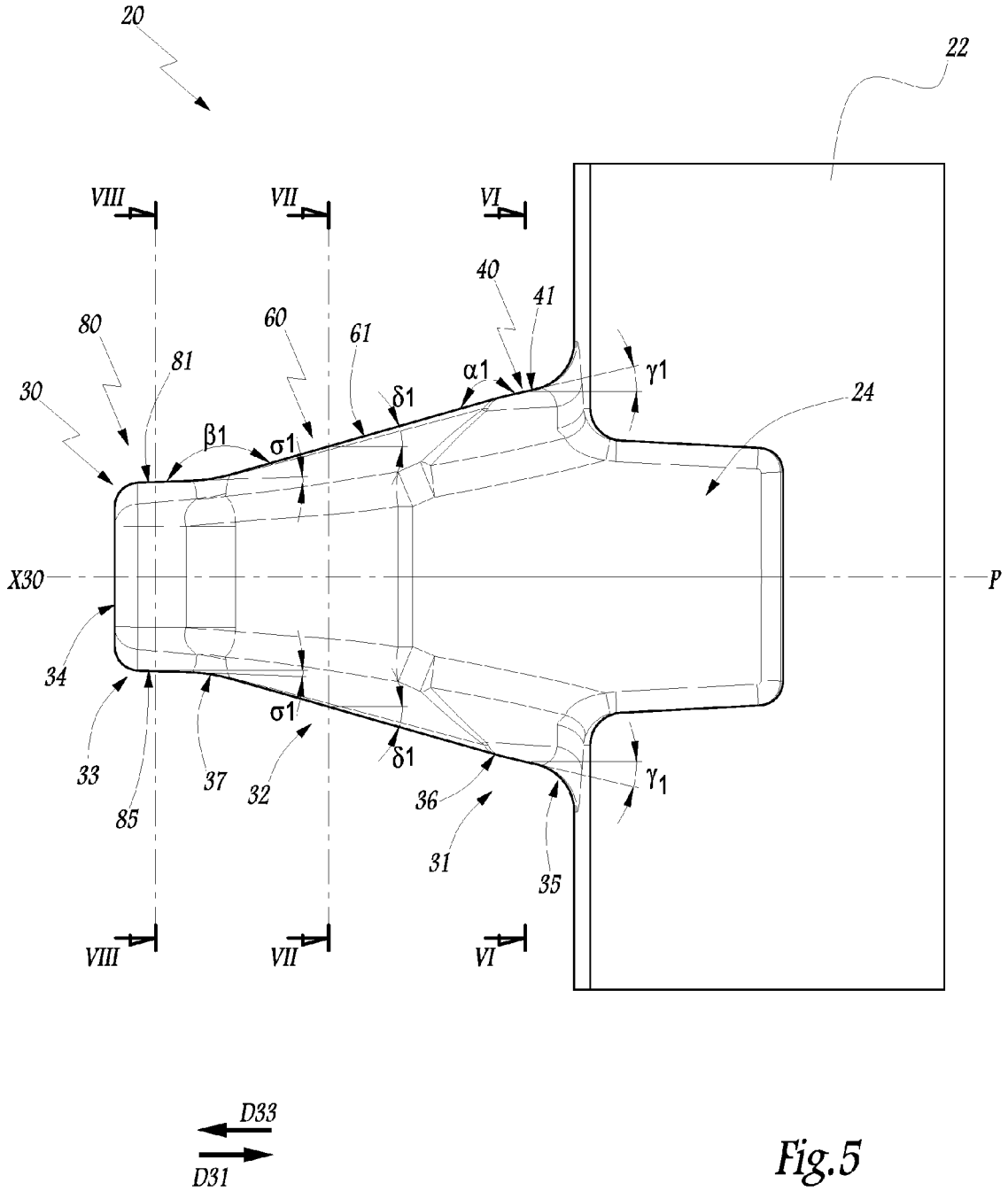

The mechanical system 1 comprises a wear part 10 of the tooth type, an adapter support 20, and a connecting device between the tooth 10 and support 20. The support 20 is secured to the bucket G, while the tooth 10 is a wear part intended to be dismantled when it is too worn by the operation of the bucket G. For the purpose of simplification, the bucket G is partially shown in FIG. 1 while the connecting device and the housings provided for the positioning of this device through the tooth 10 and the support 20 are not shown.

To facilitate the location of the various parts of the system 1 in space, there are defined a front side 2 on which the tooth 10 is situated, a rear side 3 on which the support 20 is situated, a top side 4 and a bottom side 5 oriented respectively opposite to the ground and facing the ground when the system 1 is assembled, as well as a right-hand side 6 and a left-hand side 7 defined with respect to a rear 3 -front 2 direction.

By way of non-limitative example, the connecting device may comprise a sheath and a key, adjustable through the tooth 10 and in a housing of the support 20. The device may pivot between firstly an insertion configuration where the sheath is adjusted in the housing of the support 20 while the key has no contact with the tooth 10, and secondly a locking configuration where the key bears against the tooth 10 while the sheath bears in the housing of the support 20, then forming a coupling connection between the tooth 10 and its support 20. Preferably, the connecting device extends substantially in a vertical direction directed from the top 4 towards the bottom 5, or in a horizontal direction from left 7 to right 6, or vice versa.

The tooth 10 comprises an active part 11 situated towards the front 2 and a hollow part 12 oriented towards the rear 3. In a manner known per se, the active part 11 is designed to scrape and pick up materials, for example earth or gravel, while the hollow part 12 is designed for fitting the tooth 10 on the support 20. More precisely, the part 12 comprises an internal recess, not visible in FIG. 1, provided with profiled shapes for abutment on the support 20, as well as lugs 14 that extend towards the rear 3 of the part 12. When the mechanical system 1 is in service, the main mechanical stress suffered by the tooth 10 corresponds to a digging force Fc, represented by an arrow directed onto the active part 11 in FIG. 1. The main digging exerted by the top of the tooth 10 and the secondary digging exerted by the bottom of the tooth 10 can be distinguished, the main digging being overall greater than the secondary digging.

The support 20 comprises a base 22, partially depicted in FIGS. 1 to 5, as well as a fitting nose 30 designed to be engaged in the internal recess of the tooth 10 shaped for this purpose. The part 12 and the nose 30 comprise complementary profiled abutment shapes, for forming a mechanical connection by fitting at the time of assembly and in service in the mechanical system 1. The shapes of the nose 30 are detailed below, given that the internal recess of the part 12 comprises complementary shapes, to within manufacturing clearance. Furthermore, a housing 24 for receiving the lugs 14 of the tooth 10 is provided on each side 6 and 7 of the base 22, in line with the nose 30. Each housing 24 comprises walls situated towards the rear 3, the top 4 and the bottom 5, and is open towards the front 2 in order to receive the lugs 14 oriented towards the rear 3 of the tooth 10. On assembly, the lugs 14 are received in contact towards the top 4 and the bottom 5 in the housings 24.

The nose 30 extends from the base 22 along a principal axis X30, between a proximal end 31 close to the base 22 and a distal end 33 opposite to the base 22, with a middle part 32 delimited between them. The proximal end 31 is situated towards the rear 3, while the distal end 33 is situated towards the front 2. A proximal or rear direction D31 directed towards the rear 3 is defined, and a distal or front direction D33 directed towards the front 2. The proximal direction D31 is that of the fitting of the tooth 10 on the support 20 when the system 1 is assembled, while the distal direction D33 is that of the dismantling of the tooth 10.

At the distal end 33, the end of the nose 30 terminates in a flat face 34 perpendicular to the axis X30. This face 34, also referred to as a stabilisation flat, is designed to prevent the tilting of the tooth 10 with respect to the support 20 when the system 1 is in service.

Separate zones 40, 60 and 80 are delimited on the nose 30. The zone 40 is situated in the vicinity of the proximal end 31, the zone 60 situated in the middle part 32, while the zone 80 is situated in the vicinity of the distal end 33. In the vicinity means that the zone 40 is closer to the end 31 than to the part 32 and the end 33, while the zone 80 is closer to the end 33 than to the part 32 and the end 31. Each of these zones 40, 60 and 80 comprises faces conformed so as firstly to withstand the mechanical stresses exerted by the tooth 10 on the nose 30 and secondly to limit the concentration of stresses in zones of localised weakening. At the proximal end 31, the zone 40 is connected to the base 22 by fillets 35. In the middle part 32, the zone 40 is connected to the zone 60 by a transition zone 36, while the zone 60 is connected to the zone 80 by fillets 37. At the distal end 33, the zone 80 is connected to the face 34 by fillets 38. The fillets 35 and 37 are concave while the fillets 38 are convex.

As shown in FIGS. 2 to 9, the principal axis X30 is a symmetry axis of the nose 30. A vertical plane PV is defined extending between the top 4 and the bottom 5, passing through the principal axis X30, as well as a horizontal plane PH extending between the right 6 and the left 7 passing through the principal axis X30. The planes PV and PH are two symmetry planes of the nose 30, but also of the housings 24. These symmetries facilitate the manufacture of the support 20, but in particular optimise the distribution of the forces exerted by the tooth 10 on the nose 30 and in the housings 24, whatever the direction of the stresses on the mechanical system 1.

Figure 6:
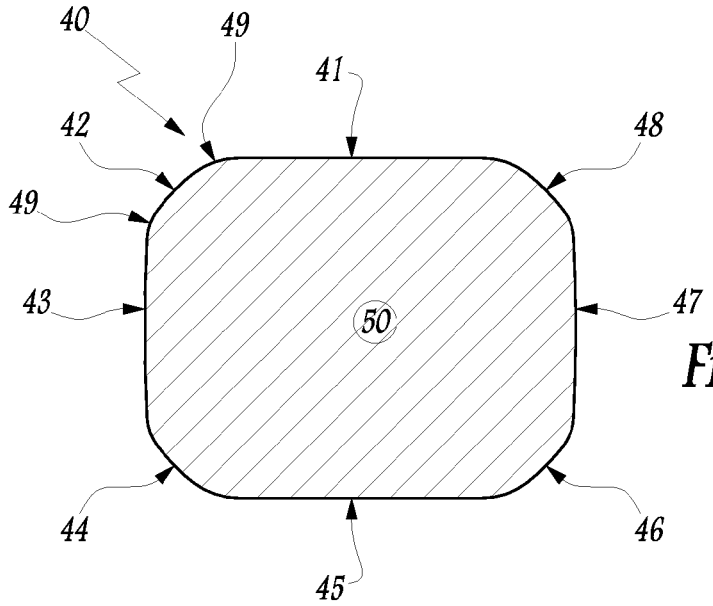
FIGS. 6, 7 and 8 are cross-sections of the support, respectively along the lines VI-VI, VII-VII and VIII-VIII in FIG. 5.
Figure 7:
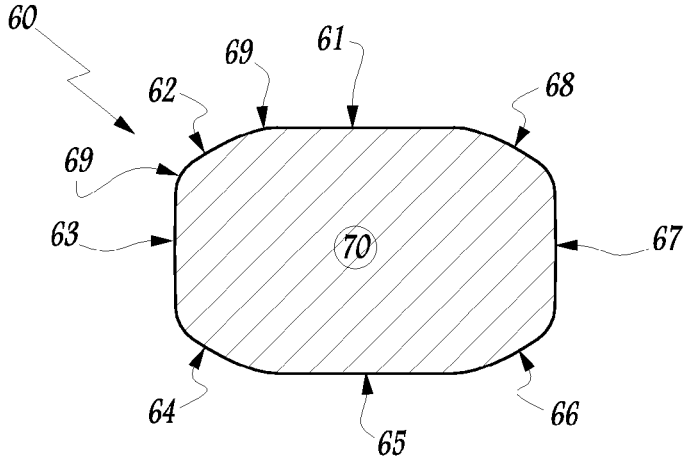
Figure 8:
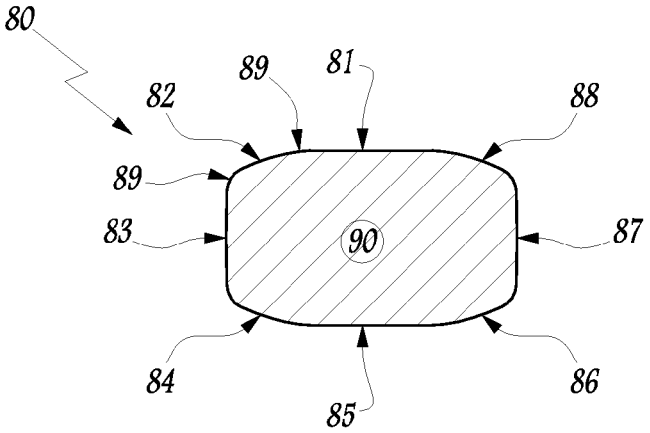
Figure 9:
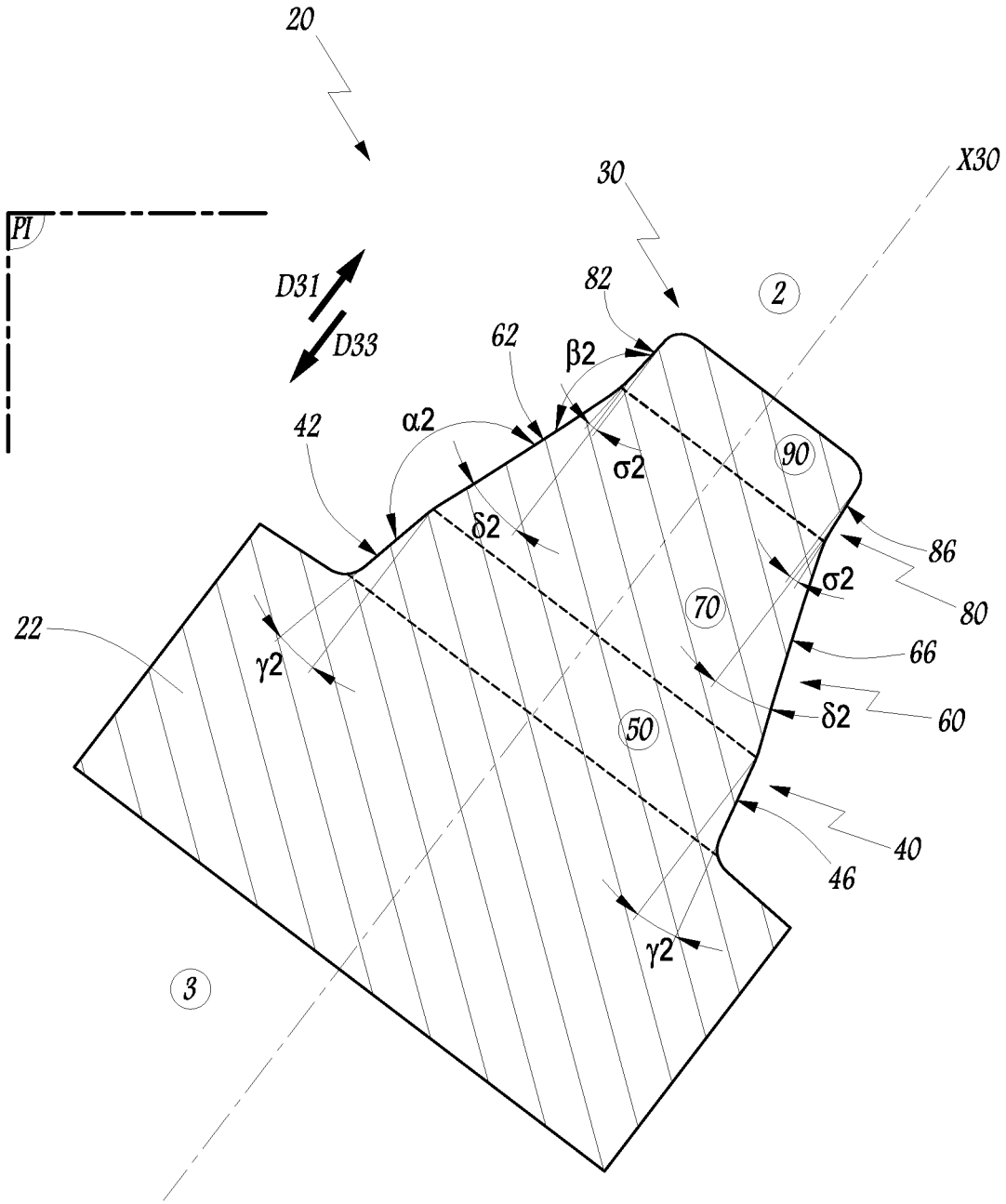
FIG. 9 is a cross-section of the support along the line IX-IX in FIG. 4.

In the preferred but non-limitative example of the figures, each of the zones 40, 60 and 80 of the nose 30 comprises eight faces opposite in pairs, in symmetry with respect to the principal axis X30. More precisely, each zone 40, 60 and 80 comprises a top face 41, 61 or 81, a right-hand top face 42, 62 or 82, a right-hand face 43, 63 or 83, a right-hand bottom face 44, 64 or 84, a bottom face 45, 65 or 85, a left-hand bottom face 46, 66 or 86, a left-hand face 47, 67 or 87, and a left-hand top face 48, 68 or 88. The profile of each zone 40, 60 and 80 of the nose 30 can therefore overall be termed octagonal: considering various cross-sections transverse to the axis X30 in these zones 40, 60 and 80, as shown in FIGS. 6 to 8, the nose 30 in cross-section comprises eight principal sides connected by fillets.

In the proximal zone 40, the faces 41 to 48 are opposite in pairs with respect to the axis X30: 41 and 45, 42 and 46, 43 and 47, 44 and 48. The faces 41-48 are flat and connected together by convex fillets 49. The faces 41-48 move closer to the axis X30 in the distal direction D33 and move away from the axis X30 in the proximal direction D31. The faces 41 and 45 are each inclined by an angle $\gamma 1$ of 13° with respect to the axis X30 and to the horizontal plane PH. The faces 42, 44, 46 and 48 are each inclined by an angle $\gamma 2$ of 13° with respect to the axis X30. The faces 43 and 47 are each inclined by an angle $\gamma 3$ of 2° with respect to the axis X30 and the vertical plane PV. In practice, the angles $\gamma 1$, $\gamma 2$ and $\gamma 3$ may respectively be between 10° and 20°, 12.5° and 17.5°, 0° and 5° inclusive.

In the middle zone 60, the faces 61 to 68 are opposite in pairs with respect to the axis X30: 61 and 65, 62 and 66, 63 and 67, 64 and 68. The faces 61-68 are connected together by substantially convex fillets 69. The faces 61-68 move closer to the axis X30 in the distal direction D33 and move away from the axis X30 in the proximal direction D31. The faces 61, 63, 65 and 67 are flat, while the faces 62, 64, 66 and 68 are warped, or more precisely twisted. In other words, the inclination of each of the faces 62, 64, 66 and 68 with respect to the planes PV and PH varies along the axis X30. The faces 61 and 65 are each inclined by an angle $\delta 1$ of 16° with respect to the axis X30 and the horizontal plane PH. For each face 62, 64, 66 and 68, a mid-plane of this face is defined, the mid-plane delimiting the same volume between the face and itself on each of its sides. In the non-limitative example in the figures, the mid-planes of the faces 62, 64, 66 and 68 are each inclined by an angle $\delta 2$ of 20° with respect to the axis X30. The faces 63 and 67 are each inclined by an angle $\delta 3$ of 20° with respect to the axis X30 and to the vertical plane PV. In practice, the angles $\delta 1$, $\delta 2$ and $\delta 3$ may respectively be between 15° and 20°, 15° and 25°, 15° and 25° inclusive.

At this stage, it should be noted that the flat faces 61 and 65 have the same inclination with respect to the plane PH and to the axis X30 as the flat faces 41 and 45 that are in line with them in the proximal direction D31. These faces 61 and 65 are those that have, among all the flat faces of the nose 30, each the largest bearing surface between the nose 30 and the tooth 10. These faces 61 and 65 may be termed primary faces of the zone 60 and are able to withstand mechanical stresses applied to the nose 30 when the digging force Fc is applied to the tooth 10. The faces 62, 63, 64, 66, 67 and 68 may be termed secondary faces of the zone 60 since they are not designed to withstand mechanical stresses exerted on the nose 30 under the action of the digging force Fc. Because of a clearance between the nose 30 and the tooth 10 that is greater at the contact interface defined by the secondary faces than at the contact interface defined by the primary faces, the secondary faces are not initially designed to come into abutment against the internal recess of the hollow part 12 of the tooth 10.

In the distal zone 80, the faces 81-88 are opposite in pairs with respect to the axis X30: 81 and 85, 82 and 86, 83 and 87, 84 and 88. The faces 81-88 are flat and connected together by substantially convex fillets 89. The faces 81-88 move closer to the axis X30 in the direction D33 and move away from the axis X30 in the direction D31. The faces 81 and 85 are each inclined by an angle $\sigma 1$ of 2° with respect to the axis X30 and to the horizontal plane PH. The faces 82, 84, 86 and 88 are each inclined by an angle $\sigma 2$ of 5° with respect to the central axis X30. The faces 83 and 87 are each inclined by an angle $\sigma 3$ of 2° with respect to the axis X30 and to the vertical plane PV. Each flat face 81-88 of the second zone 80 is less inclined with respect to the principal axis X30 than the flat face 41-48 of the first zone 40 that is situated in line with it in the proximal direction D31. In practice, the angles σ1, σ2 and σ3 may be respectively between 0° and 5° inclusive.

Like the faces 61 and 65, the faces 41, 45, 81 and 85 may be termed primary faces, able to withstand mechanical stresses applied to the nose 30 when the digging force Fc is applied to the tooth 10. Like the faces 62, 64, 66 and 68, the faces 42, 44, 46, 48, 82, 84, 86 and 88 may be termed secondary faces since they are not designed to withstand mechanical stresses applied to the nose 30 under the action of the digging force Fc. On the other hand, unlike the faces 63 and 67, the faces 43, 47, 83 and 87 are designed to withstand mechanical stresses exerted on the nose 30 when a lateral force is applied to the tooth 10.

Particularly advantageously, the secondary faces of the various zones 40, 60 and 80 reduce the stress concentrations in the system 1, while minimising the total weight of the nose 30, because of their arrangement and their particular shape. The support 20 and the nose 30 are solid whereas the tooth 10 is hollow in the part 12 thereof. For an equivalent weight of the support 20, the nose 30 comprises less material, which makes it possible to have more material on the attachment of the support 20 to the bucket G and further improve its service life. Equally, a less bulky nose 30 makes it possible to produce a tooth 10 that is less bulky in height, which facilitates the penetration of the tooth/support/bucket assembly in the material. Finally, for the same external profile of the tooth 10, a less bulky nose 30 makes it possible to have more material in the tooth 10, at its internal recess. Consequently, the mechanical strength of the tooth 10 is improved, as well as the ratio of the weight of the worn tooth to the weight of the new tooth.

As shown in FIGS. 6 to 9, the nose 30 comprises a set of cross-sections 50, 70 and 90, defined in planes perpendicular to the principal axis X30. These cross-sections 50, 70, 90 change in the proximal direction D31, delimiting increasing or constant areas, in particular delimiting no decreasing area. The areas in question are in fact those delimited by the envelope of the transverse cross-sections 50, 70 and 90, given that the zone 40 is able to have the housing for receiving the connecting device pass through it, which are not depicted for the purpose of simplification. The housing is formed transversely to the axis X30, preferably along the horizontal plane PH or the vertical plane PV, depending on the configuration of the mechanical system 1. The cross-sections 50 comprising this housing have areas that are smaller in comparison with the adjacent cross-sections 50 with no housing, but nevertheless the areas of the envelopes of the transverse cross-sections 50, 70 and 90 actually change in an increasing or constant manner in the proximal direction D31. Apart from the obligatory presence of this housing in the nose 30, cross-sections decreasing in the direction D31 are to be avoided since they represent the presence of a zone of localised weakening of the nose 30.

The cross-sections 50 constitute a first type of cross-section defined in the zone 40, the cross-sections 90 constitute a second type of cross-section defined in the zone 80, while the cross-sections 70 constitute a third type of cross-section defined in the zone 60. For each zone 40, 60 and 80, a rate of increase of the area of the cross-sections, respectively 50, 70 and 90, per unit length along the axis X30 in the proximal direction D31, is defined. The rate of increase per unit length of each type of cross-section 50, 70 or 90 depends on the inclination of the faces in the corresponding zone, or in other words depends on the angles γ1, γ2 and γ3 for the cross-sections 50, the angles δ1, δ2 and δ3 for the cross-sections 70 and angles σ1, σ2 and σ3 for the cross-sections 90. The rate of increase of the areas delimited by the cross-sections 70 is greater than the rate of increase of the areas delimited by the cross-sections 50, which is greater than the rate of increase of the areas delimited by the cross-sections 90, in the proximal direction D31.

Moreover, angles α1 and β1 are defined in the vertical plane PV. Each angle α1 is defined, at the surface of the nose 30, between the faces of the zones 40 and 60 that are situated in the plane PV on the same side of the axis X30, that is to say between the faces 41 and 61 or between the faces 45 and 65. Each angle β1 is defined, on the surface of the nose 30, between the faces of the zones 60 and 80 that are situated in the plane PV on the same side of the axis X30, that is to say between the faces 61 and 81 or between the faces 65 and 85. The angle α1 is between 180° and 200°, in this case equal to 180° in the figures, while the angle β1 is between 160° and 180°, in this case 160° in the figures.

In addition, a set of planes PI is defined, which comprise the principal axis X30, which are inclined with respect to the planes PV and PH and intersect the inclined faces 42, 44, 46, 48, 62, 64, 66, 68, 82, 84, 86 and 88. By way of example, the plane PI shown in FIGS. 4 and 9 intersects the faces 42, 62 and 82 on the right-hand top side of the axis X30 and intersects the opposite faces 46, 66 and 86 on the left-hand bottom side of the axis X30. Angles α2 and β2 for a given plane PI are also defined. Each angle α2 is defined, on the surface of the nose 30, between an inclined face of the zone 40 and an inclined face of the zone 60 that are situated in the same plane PI and on the same side of the axis X30, for example between the face 42 and the face 62. Each angle β2 is defined, on the surface of the nose 30, between an inclined face of the zone 60 and an inclined face of the zone 80 that are situated in the same plane PI and on the same side of the axis X30, for example between the face 62 and the face 82. It should be noted that the angles α2 and β2 are variable according to the plane PI chosen, because in particular of the twisted shape of the faces 62, 64, 66 and 68. Preferably, the plane PI can be chosen as being perpendicular to the mid-plane, defined above, of the twisted faces. The important thing is that, whatever the plane PI chosen, the angle α2 is between 180° and 200°, preferably equal to 190°, while the angle β2 is between 160° and 180°, preferably equal to 170°. In the plane PI shown in FIGS. 4 and 9, the angles α2 and β2 are equal respectively to 190° and 170°.

Also angles α3 and β3 are defined in the horizontal plane PH. Each angle α3 is defined, on the surface of the nose 30, between the faces of the zones 40 and 60 that are situated in the plane PH on the same side of the axis X30, that is to say between the faces 43 and 63 or between the faces 47 and 67. Each angle β3 is defined, on the surface of the nose 30, between the faces of the zones 60 and 80 that are situated in the plane PH on the same side of the axis X30, that is to say between the faces 63 and 83 or between the faces 67 and 87. The angle α3 is between 180° and 200°, in this case equal to 200° in the figures, while the angle β3 is between 160° and 180°, in this case equal to 160° in the figures.

Whatever the longitudinal cross-section of the nose 30 in question, all the angles between the adjacent planes are therefore obtuse. The flat faces 41-61-81, 42-62-82, 43-63-83, 44-64-84, 45-65-85, 46-66-86, 47-67-87 and 48-68-88 that are situated firstly in the same plane PV, PI or PH comprising the principal axis X30 and secondly on the same side of the principal axis X30, are inclined with respect to one another at obtuse angles α1, α2, α3, β1, β2 and β3 that are always between 160° and 200°. In addition, the adjacent flat faces of the same zone 40, 60 or 80 are inclined with respect to one another by no more than 60°, in planes perpendicular to the axis X30, without defining a re-entrant hollow in the nose 30. The large surface zone of the flat faces affords a good distribution of the forces at the interface between the nose 30 and the tooth 10. The size of the fillets or transition zones 35, 36, 37, 38, 49, 69 and 89 connecting the flat faces is reduced to the maximum possible extent.

Thus the particular shape of the nose 30 and therefore the internal shape of the hollow part 12 of the tooth 10 that results from that of the nose 30 greatly reduce the concentrations of stresses internal to the system 1 according to the invention, which increases its service life.

In practice, the application of the digging force Fc has a tendency to tilt the tooth 10 on its adapter support 20. By virtue of the jamming of the lugs 14 in the housings 24, as well as the presence of the stabilisation flat formed by the face 34, a critical tilting of the tooth 10 can be avoided. With the wear on the mechanical system 1, the contact interfaces situated between the lugs 14 and the housings 24 and between the distal end 33 of the nose 30 and the part 12 of the tooth 10 are no longer predominant. In particular, the wall of the internal recess of the tooth 10 is able to bear very greatly on the bottom part of the nose 30 under the action of the force Fc. As long as the clearances between the tooth 10 and the support 20 are small, the permitted tilting of the tooth 10 is also small and the stresses exerted on the contact interfaces are acceptable. When the clearance between the tooth 10 and its support 20 increases, the part 12 is liable to crack, tear or burst, making the tooth 10 unusable. Under these circumstances, it is particularly advantageous to reduce the stress concentrations and thus increase the resistance of the tooth 10 to shattering.

The mechanical system 1 according to the invention is well suited for undergoing forces coming from all directions, in addition to the digging force Fc. When a force is applied to the tooth 10, the support 20 and the wear part 10 comprise at least one contact interface among:

- a first contact interface situated between each lug 14 and the housing 24 receiving this lug 14,
- a second contact interface situated between the tooth 10 and the flat faces of the zone 80 that extend substantially perpendicular to the force,
- a third contact interface situated between the tooth 10 and the flat faces of the zone 40 that extend in line with the second contact interface in the proximal direction D31,
- a fourth contact interface situated between the tooth 10 and the flat faces of the zone 60 that extend in line with the second contact interface in the proximal direction D31,
- a fifth contact interface situated between the tooth 10 and the flat face 34.

In service, the number of simultaneous contact interfaces depends firstly on the direction of the force exerted on the tooth 10 and secondly on the wear on the tooth 10 and/or on the support 20. The contact interfaces are generally stressed in an order ranging from the first contact interface to the fifth contact interface.

Moreover, the elements making up the system 1 may be conformed differently without departing from the scope of the invention. In particular, the nose 30 may be conformed according to various variants detailed below. The internal recess of the tooth 10 is conformed according to the shape of the nose 30.

In a variant that is not shown, the nose 30 has only one symmetry plane among the vertical plane PV or the horizontal plane PH, this symmetry plane including the principal axis X30.

According to another variant, not shown, the zones 40, 60 and 80 or some of these zones of the nose 30 may have a roughly hexagonal transverse profile. In this case, considering various cross-sections transverse to the axis X30 in these particular zones 40, 60 and 80, the nose 30 in cross-section comprises six principal sides connected by rounded fillets.

According to another variant, not shown, the nose 30 may have a transverse profile that is at least partly decagonal, dodecagonal, etc. In other words, at least some of the zones 40, 60 and 80 may have a number of flat faces in opposite pairs that is equal and greater than six.

According to another variant that is not shown, the nose 30 does not comprise an intermediate zone 60, but only zones 40 and 80 each comprising at least six flat faces.

According to a variant that is not shown, the middle zone 60 of the nose 30 comprises two flat faces 61 and 65 perpendicular to the vertical plane PV, preferably two flat faces 63 and 67 perpendicular to the horizontal plane PH, and at least four faces 62, 64, 66, 68 oriented otherwise than at a right angle both with respect to the vertical plane PV and with respect to the horizontal plane PH.

Preferably, the number of flat faces of the zone 40 is greater than or equal to the number of flat or twisted faces of the zone 60, which is greater than or equal to the number of flat faces of the zone 80, which is greater than or equal to six.

Preferably also, at least some opposite flat faces of the zone 40 and/or of the zone 80 are parallel in pairs, on either side of the axis X30. For example, the faces 43 and 47 may be parallel to each other and to the plane PV. According to another example, the zone 80 may comprise six faces among which the top face 81 oriented towards the top 4 and the bottom face 85 oriented towards the bottom 5 are parallel. Advantageously, the zone 80 comprises at least six or eight flat faces parallel in pairs.

Furthermore, the connecting device between the tooth 10 and the support 20 may be of any type suited to the present application.

The technical features of the various embodiments may, in their entirety or with some of them, be combined with each other. Thus the mechanical system may be adapted in terms of manufacturing and operational constraints.

By virtue of the invention, the tooth 10 and the support 20 are conformed so as to absorb stresses of all kinds and all directions, while reducing the zones of localised weakening and the phenomena of wear.

The invention claimed is:

1. A mechanical system (1) comprising:

a support (20) of a civil engineering machine bucket (G), the support (20) being comprised of i) a base (22), ii) a nose (30) that extends from the base (22) along a principal axis (X30), and iii) a pair of housings (24) within the base (22), one of said housings (24) on each side of the nose (30) in line with the nose (30), each said housing (24) having an open side in a distal direction (D33) and three closed sides; and a wear part (10) that fits on the nose (30), the wear part having a front distal end with an active part (11), and a rear proximal end with a hollow part (12) and lugs (14) that extent rearward from the hollow part (12), wherein, the nose (30) includes a proximal end (31) close to the base (22) and a distal end (33) opposite to the base (22), the nose has a set of cross-sections (50, 70, 90), in planes perpendicular to the principal axis (X30), where when considered in a proximal direction (D31) from the distal end towards the proximal end, each successive one of said cross-sections delimits an increased or constant area as compared to an area of an immediately preceding one of said cross-sections, and each of the lugs (14) of the wear part (10) is received in a corresponding one of the housings (24) in the base (22), and the nose (30) further comprises:

a first zone (40) that is situated in the vicinity of the proximal end (31) of the nose (30) and comprises at least six flat faces (41-48) opposite in pairs (41, 45; 42, 46; 43, 47; 44, 48) delimiting cross-sections of a first type (50), and a second zone (80) that is situated in the vicinity of the distal end (33) of the nose (30) and comprises at least six flat faces (81-88) opposite in pairs (81, 85; 82, 86; 83, 87; 84, 88) delimiting cross-sections of a second type (90), each flat face (81-88) of the second zone (80) being less inclined, with respect to the principal axis (X30), than the flat face (41-48) of the first zone (40) that is situated in line with said flat face (81-88) of the second zone (80) along the proximal direction (D31).

2. The mechanical system (1) according to claim 1, wherein the first zone (40) of the nose (30) comprises at least eight flat faces (41-48) opposite in pairs (41, 45; 42, 46; 43, 47; 44, 48).

3. The mechanical system (1) according to claim 2, wherein at least some of the opposite flat faces (41-48) of the first zone (40) are parallel to each other.

4. The mechanical system (1) according to claim 1, wherein the second zone (80) of the nose (30) comprises at least six flat faces (81-88) parallel in pairs (81, 85; 82, 86; 83, 87; 84, 88).

5. The mechanical system (1) according to claim 4, wherein the second zone (80) of the nose (30) comprises at least eight flat faces (81-88) parallel in pairs (81, 85; 82, 86; 83, 87; 84, 88).

6. The mechanical system (1) according to claim 1, wherein the nose (30) comprises a third intermediate zone (60) between the first zone (40) and the second zone (80) of the nose (30) along the principal axis (X30), the third zone (60) comprising at least six faces (61-68) opposite in pairs (61, 65; 62, 66; 63, 67; 64, 68) delimiting cross-sections of a third type (70) in planes perpendicular to the principal axis (X30), the areas delimited by the cross-sections of the third type (70) having, in the proximal direction (D31), a rate of increase greater than the rate of increase of the areas delimited by the cross-sections of the first type (50) and the rate of increase of the areas delimited by the cross-sections of the second type (90).

7. The mechanical system (1) according to claim 6, wherein the third zone (60) comprises at least four flat faces (61, 63, 65, 67) and four left-hand faces (62, 64, 66, 68) opposite in pairs (61, 65; 62, 66; 63, 67; 64, 68).

8. The mechanical system (1) according to claim 6, wherein the flat faces (41-48, 61-68, 81-88) of the first zone (40), of the second zone (80) and of the third zone (60) that are situated firstly in the same plane (PV; PI, PH) comprising the principal axis (X30) and secondly on the same side of the principal axis (X30), are inclined with respect to each other at obtuse angles ($\alpha 1$, $\alpha 2$, $\alpha 3$, $\beta 1$, $\beta 2$, $\beta 3$) of between 160 and 200 degrees.

9. The mechanical system (1) according to claim 6, wherein the flat faces (61-68) of the third zone (60) comprise:

firstly, primary faces (61, 65) having the same inclination with respect to the principal axis (X30) as the flat faces (41, 45) of the first zone (40) that are in line with them in the proximal direction (D31), these primary faces (61, 65) being able to withstand mechanical stresses exerted on the nose (30) when a digging force (Fc) is applied to the wear part (10), and secondly, secondary faces (62, 63, 64, 66, 67, 68) overall more inclined with respect to the principal axis (X30) than the flat faces (42, 43, 44, 46, 47, 48) of the first zone (40) that are in line with them in the proximal direction (D31).

10. The mechanical system (1) according to claim 6, wherein the third zone (60) of the nose (30) comprises:

two flat faces (61, 65) perpendicular to a vertical plane (PV), and at least four faces (62, 64, 66, 68) oriented otherwise than at a right angle both with respect to the vertical plane (PV) and with respect to the horizontal plane (PH).

11. The mechanical system (1) according to claim 10, wherein the third zone (60) of the nose (30) comprises two flat faces (63, 67) perpendicular to a horizontal plane (PH).

12. The mechanical system (1) according to claim 6, wherein when a force (Fc) is applied to the wear part (10), the support (20) and the wear part (10) comprise at least one contact interface from:

a first contact interface situated between each lug (14) and the housing (24) receiving this lug (14), a second contact interface situated between the wear part (10) and the flat faces (81, 85) of the second zone (80) that extend substantially perpendicular to the force (Fc), a third contact interface situated between the wear part (10) and the flat faces (41, 45) of the first zone (40) that extend in line with the second contact interface in the proximal direction (D31), a fourth contact interface situated between the wear part (10) and the flat faces (61, 65) of the third zone (60) that extend in line with the second contact interface in the proximal direction (D31), and a fifth contact interface situated between the wear part (10) and a flat face (34) that is perpendicular to the principal axis (X30) and arranged at the distal end (33) of the nose (30), the number of simultaneous contact interfaces in service depending on the direction of the force (Fc) and on the wear on the wear part (10) and/or support (20).

13. The mechanical system (1) according to claim 1, wherein when a force (Fc) is applied to the wear part (10), the support (20) and the wear part (10) comprise at least one contact interface from:

a first contact interface situated between each lug (14) and the housing (24) receiving this lug (14), a second contact interface situated between the wear part (10) and the flat faces (81, 85) of the second zone (80) that extend substantially perpendicular to the force (Fc), a third contact interface situated between the wear part (10) and the flat faces (41, 45) of the first zone (40) that extend in line with the second contact interface in the proximal direction (D31), and a contact interface situated between the wear part (10) and a flat face (34) that is perpendicular to the principal axis (X30) and arranged at the distal end (33) of the nose (30), the number of simultaneous contact interfaces in service depending on the direction of the force (Fc) and on the wear on the wear part (10) and/or support (20).

14. The mechanical system (1) according to claim 1, wherein the nose (30) has at least one symmetry plane (PV; PH) including the principal axis (X30).

15. A civil engineering machine bucket (G), comprising at least one mechanical system (1) according to claim 1.

16. The mechanical system (1) according to claim 1, wherein the successive ones of the set of cross-sections (50, 70, 90) of the nose do not delimit any decreasing area, apart from the presence of the housings for receiving a connection device in the nose (30).

17. The mechanical system (1) according to claim 1, wherein the nose (30) has at least one symmetry plane (PV; PH) including at least one of the group consisting of a vertical plane (PV) and a horizontal plane (PH).

18. The mechanical system (1) according to claim 14, wherein the principal axis (X30) is a symmetry axis of the nose (30).

19. The mechanical system (1) according to claim 17, wherein the principal axis (X30) is a symmetry axis of the nose (30).

* * * * *